US006164600A

United States Patent [19]

Seidl et al.

[11] Patent Number: 6,164,600

[45] Date of Patent: Dec. 26, 2000

[54] DEVICE FOR DETECTING THE POSITIONS OF PIVOTABLE PARTS OF A POINT

[75] Inventors: Kurt Seidl, Fohnsdorf, Austria; Josef Frauscher, Ruhstorf, Germany

[73] Assignee: VAE Aktiengesellschaft, Vienna, Austria

[21] Appl. No.: 09/142,769

[22] PCT Filed: Mar. 11, 1997

[86] PCT No.: PCT/AT97/00051

§ 371 Date: Sep. 14, 1998

§ 102(e) Date: Sep. 14, 1998

[87] PCT Pub. No.: WO97/33784

PCT Pub. Date: Sep. 18, 1997

[30] Foreign Application Priority Data

Mar. 12, 1996 [AT] Austria ..... 468/96

[51] Int. Cl.[7] ..... B61L 5/00

[52] U.S. Cl. ..... 246/220; 246/121; 246/162; 246/176; 246/476

[58] Field of Search ..... 246/120, 121, 246/162, 176, 220, 253, 476, 458

[56] References Cited

U.S. PATENT DOCUMENTS

| | | | |
|---|---|---|---|
| 4,986,498 | 1/1991 | Rotter et al. | 246/458 |
| 5,253,830 | 10/1993 | Nayer et al. | 246/220 |
| 5,806,806 | 9/1998 | Danner | 246/220 |

FOREIGN PATENT DOCUMENTS

| | | |
|---|---|---|
| 373 836 | 2/1984 | Austria . |
| 514 365 | 11/1992 | European Pat. Off. . |
| 35 11 891 | 10/1986 | Germany . |
| 35 40 307 | 5/1987 | Germany . |

*Primary Examiner*—Mark T. Le
*Attorney, Agent, or Firm*—Pillsbury Madison & Sutro LLP

[57] ABSTRACT

Device for detecting the positions of pivotable parts of a rail switch, such as, e.g., tongue rails (1, 2) by at least one sensor designed as a continuous distance sensor (4,5,6,7), wherein the sensor output is connected to a circuit arrangement (10) for two separate evaluations, the first evaluation being configured as a distance evaluation and the second evaluation being configured as a function control of the sensor, as well as a method for evaluating signals.

8 Claims, 2 Drawing Sheets

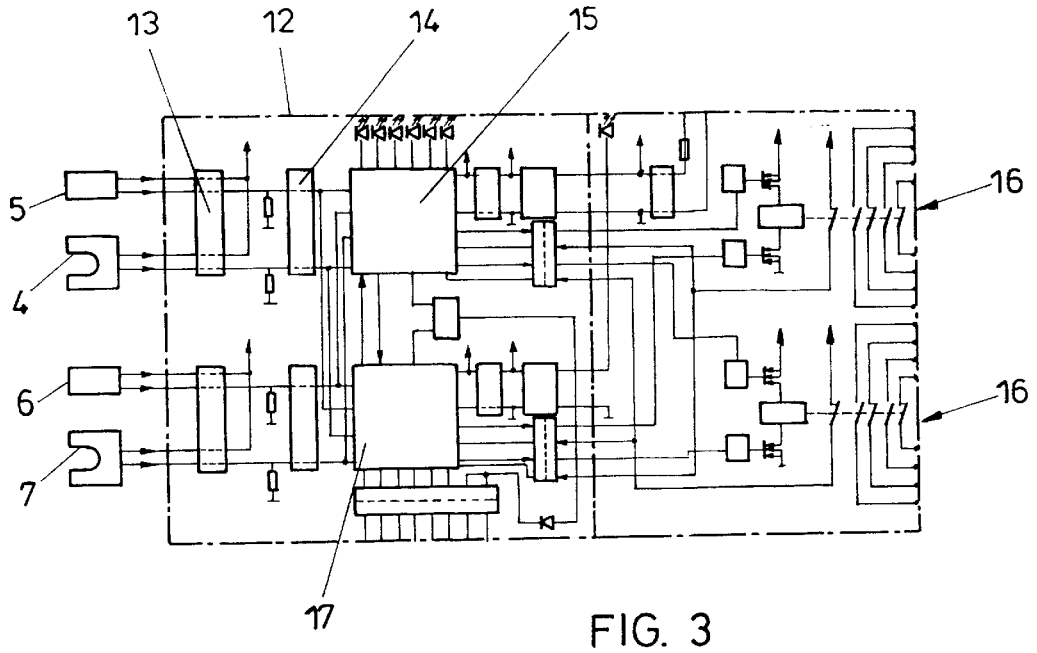
FIG. 3
FIG. 4
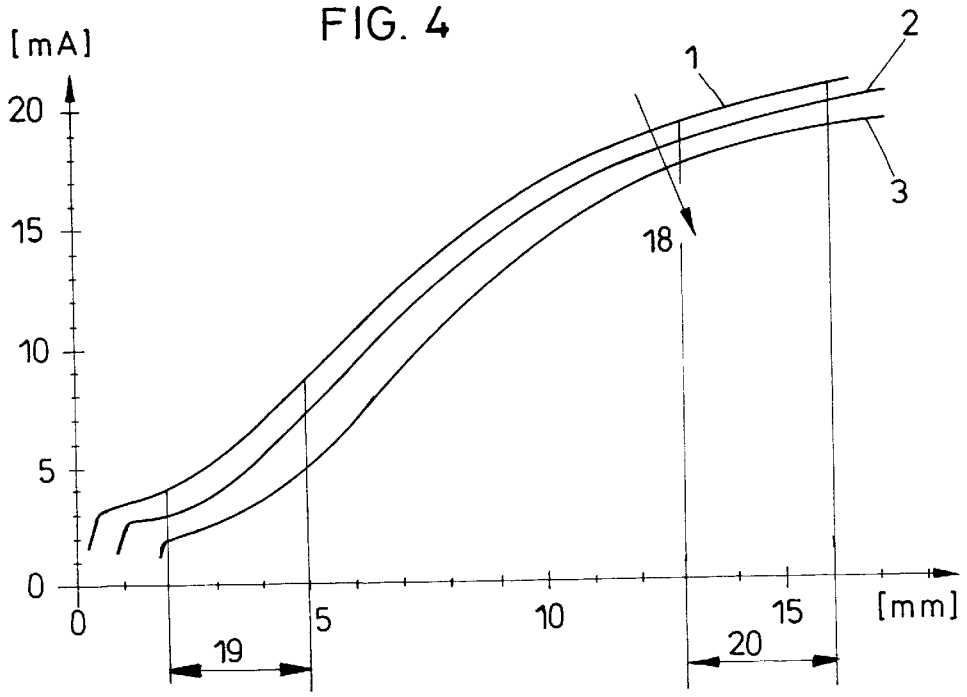

DEVICE FOR DETECTING THE POSITIONS OF PIVOTABLE PARTS OF A POINT

BACKGROUND OF THE INVENTION

1. Field of the Invention

The invention relates to a device for detecting the positions of pivotable parts of a rail switch, such as, e.g., tongue rails by at least one sensor as well as a method for evaluating sensor signals with a view to determining the positions of pivotable parts of a rail switch.

2. Prior Art

Due to the ever increasing extension of high-speed lines for railways, demands on the check of rail switches are growing, in particular. In order to guarantee the safe operation of a railway, crossings of rail switches must take place at the highest degree of safety. To this end, it is absolutely necessary for the switch tongues to correctly assume, and also maintain, their end positions after having been pivoted by appropriate actuation drives. So far, tongue position detectors comprising mechanical end switches have been used to check these end positions. Yet, such mechanical devices are relatively complex and expensive, since they frequently are comprised of rod assemblies readily prone to damage and hence requiring frequent maintenance and readjustment. In addition to such mechanically operating position detectors, devices have become known which are comprised of inductively acting non-contact approximation switches.

From DE 35 11 891 A1 a device has become known, which consists of an electromotor-driven single-rail-switch actuator, a fixable adjustment slide and optionally a likewise fixable monitoring slide as well as a sensor arrangement for recognizing the end positions of the slides and their safeguarding states. By means of sensors integrated in such devices, the end positions are monitored and the locking position of the adjustment slide and optionally of the monitoring slide are recognized. The checking results are then transmitted to a control and monitoring lagic and/or a controlling interlocking installation while determining the practicability of the railway switch. No measurement of the distance between the tongue rail and the stock rail is provided.

From DE 26 36 359 A1, a device for monitoring the end positions of pivotable rails of railway switches has become known, wherein inductive switches are provided on defined control points and scanned by ferromagnetic counterparts arranged on the pivotable rail. By the inductively induced triggering of the switch, it is to be determined whether the pivotable rail has assumed its end position.

From EP 0 514 365 B1, a method for monitoring the state of rail switches and detecting premature wear in the region of the tongue rails of a rail switch has already been apparent. That method substantially aims at detecting by means of a sensor premature wear in the region of the tongue rail so as to store the smallest value of the distance between tongue rail and stock rail detected during crossing, while defining distance values and limit values in each case and comparing the same and triggering a maintenance signal upon exceeding of a defined limit value. Inductive or capacitive analog sensors are provided as potential approximation sensors.

Although such inductively acting approximation switches are very reliable and wear-free control elements, they cannot be used for continuously detecting the exact positions of the movable parts of a rail switch but are employed only for signalizing whether the tongue of a rail switch has reached the respective end position or not. Since inductively acting approximation switches are inserted in resonant circuits, the accuracy of any measurements is subject to the quality of the resonant circuit, which in turn strongly depends on external influences and on the accuracy of the structural components. It is, therefore, necessary to take expensive measures in order to enhance the redundancy and accuracy of such measuring devices.

SUMMARY OF THE INVENTION

The present invention aims at providing a measuring device for continuously measuring the positions of the movable parts of a rail while constantly monitoring their functionability. To solve this object, the device according to the invention is realized in a manner that the sensor is designed as a continuous distance sensor and the sensor output is connected to a circuit arrangement for two separate evaluations, the first evaluation being configured as a distance evaluation and the second evaluation being configured as a function control of the sensor. Due to the fact that the sensor is designed as a continuous distance sensor, all of the end positions of the switch tongue can be precisely detected over the total adjustment range as opposed to measuring sensors that are merely suitable for detecting a state. A circuit arrangement is provided for evaluating signals, wherein it is feasible by means of a function control, e.g., by providing a reference signal, whether the sensor is intact and yields correct measuring results. The continuous determination of the position is carried out in the distance evaluation with a possible way of detecting the position residing in the calculation of the position. High-performance microcontrollers having high clock rates are usually used for rapidly processing, by way of analog-to-digital conversion, measuring data available in the discrete form. Since the position of the tongue rail, as a rule, is not linearly dependent on the sensor signal, the distance evaluation in a particularly advantageous manner is configured so as to cooperate with a characteristic curve interrogation. By means of such a characteristic curve interrogation, the exact determination of the position of the tongue rail is feasible even if the measuring signals are not based on a linear distance law.

A particularly preferred further development of the measuring device consists in that the output of at least one further sensor for measuring the static signal is connected with the function control. Due to the fact that a further sensor which is either specially calibrated or identical with the distance sensor proper is employed in this further development, the accuracy of the measurement of the static signal and hence the reliability of the function control are enhanced.

In order to further increase the accuracy in the determination of the positions of pivotable parts of a rail switch, a particularly suitable configuration is devised such that at least two distance sensors are each arranged at the open and closed positions of the pivotable parts on the track. By appropriately arranging several distance sensors, a further function control in the damped end position may be effected in addition to the function control in the undamped state. The use of at least two distance sensors installed on different sites, furthermore, offers the opportunity to enhance the reliability of the function control and the accuracy of the distance measurement by comparing the measured data and/or by averaging. Moreover, such a configuration serves to observe the tongue rails over the entire length of a rail switch as to changes in shape, measurements being feasible even during passage. In this manner, the overall state of the position of a rail switch may be ascertained and long-term changes may be predetermined.

In a preferred further development, a characteristic curve is designed so as to comprise the respective tolerance ranges for admissible functional ranges for the open and closed positions of the pivotable parts and that a function control is effected for the open and closed positions. By the fact that tolerance limits are provided, the function control is prevented from emitting an alarm signal already at slight deviations from the end positions thus terminating operation too early in really non-critical ranges. The configuration provided allows for the continuous control also of changes of the end positions and to carry out repair and adjustment operations coming up early at measuring data lying within the tolerance limits. Thereby, it is possible to observe the progress of wear within the tolerance limits so as to save both material and costs.

In a particularly preferred embodiment, it is provided that the static signal cooperates with the characteristic curve interrogation as a calibration quantity for the characteristic curve. By using the static signal for displacing the characteristic curves themselves so as to render the value of the static signal equal to the functional value in the open position, a family of characteristics is formed. By such a self-adjustment of the characteristic curves while forming of a family of characteristics, it becomes possible to largely eliminate environmental and ageing influences on evaluation and to obtain unfalsified position data.

In order to prevent a further disturbance variable in the form of line losses, e.g., resistivity voltages drops, the sensor outputs advantageously are designed as power outputs. By designing the sensor outputs as power outputs, the sensor signals are present in the form of readily processible currents.

In order to determine the tendencies of the behaviour of a rail switch over an extended period of time, i.e., to recognize premature wear and to estimate the remaining service life of a rail switch, the evaluation circuit preferably is connected with a memory.

In order to monitor the safe functioning of the locks and to check the narrowest passage, the distance sensors according to another advantageous configuration are arranged in several measuring planes.

The method for evaluating the signals of the sensors with a view to determining the position of pivotable parts of a rail switch using the device according to the invention essentially consists in that the sensor signals are evaluated in a characteristic curve computer, the positions are determined as the functions of the signal data, wherein the signals are compared with the static signals of the sensors and the functionability of the sensors is assessed and, if required, signal data located beyond tolerance ranges allowed in the characteristic curves are used for error messages, wherein the characteristic curve is adapted to the respective environmental conditions by comparison with the static current signals within an admissible tolerance and short-term error messages are suppressed. By carrying out the analysis of the data detected by means of the sensors with a view to both determining the distance and checking the functionability of the sensors while simultaneously adapting the characteristic curve, falsifications affecting the measuring device by disturbance variables are largely eliminated, thereby increasing the measuring accuracy to a high degree. Since error messages are triggered only by signal data located beyond the tolerance ranges allowed in the characteristic curves, an operating range is defined within said tolerances, thereby ensuring that interruptions of operation will not be caused at already small deviations of the tongue rails from the end positions, faultless operation still being feasible without any risks. As a result, such a measuring-technique-based method, on the whole, raises the period of use of tongue rails of rail switches. If, however, a signal leaves the tolerance range, either the switch tongue has moved or the sensor has become defect. In the light of the safety guidelines provided by the railway law, the simultaneous occurrence of both of said failures may be excluded. If an actual source of error is to be detected, the sensor must be checked when idle. Due to the fact that even the time of an error message is detected by way of storage, error messages originating from possible freak values, e.g., caused by the accidental damping of a distance sensor by persons or animals, and hence being only of a short-term character may be suppressed. The operability of the rail switch in that case will not be interrupted. By the arrangement and the evaluation method it is also ensured that defect sensors or failure of a sensor will cause an interruption of operation.

In a particularly preferred operating step, the operability of the switching actuator is monitored in addition, an even higher reliability of the switch setting device thus being obtained. By monitoring the switching actuator, it is ensured that failures going back to the switching actuator and not to age-related wear or other environmental disturbances of the tongue rail will be recognized in time. Thus, it is feasible to constantly and separately monitor any principal error sources directly resulting in the shutdown and repair of a rail switch.

A further advantageous method step for monitoring the safe functioning of the locks and checking the narrowest passage consists in that the signals derived from different measuring planes are compared with one another.

BRIEF DESCRIPTION OF THE DRAWINGS

In the following, the invention will be illustrated and explained in more detail by way of drawings.

DETAILED DESCRIPTION OF A PREFERRED EMBODIMENT OF THE INVENTION

Figure 1:
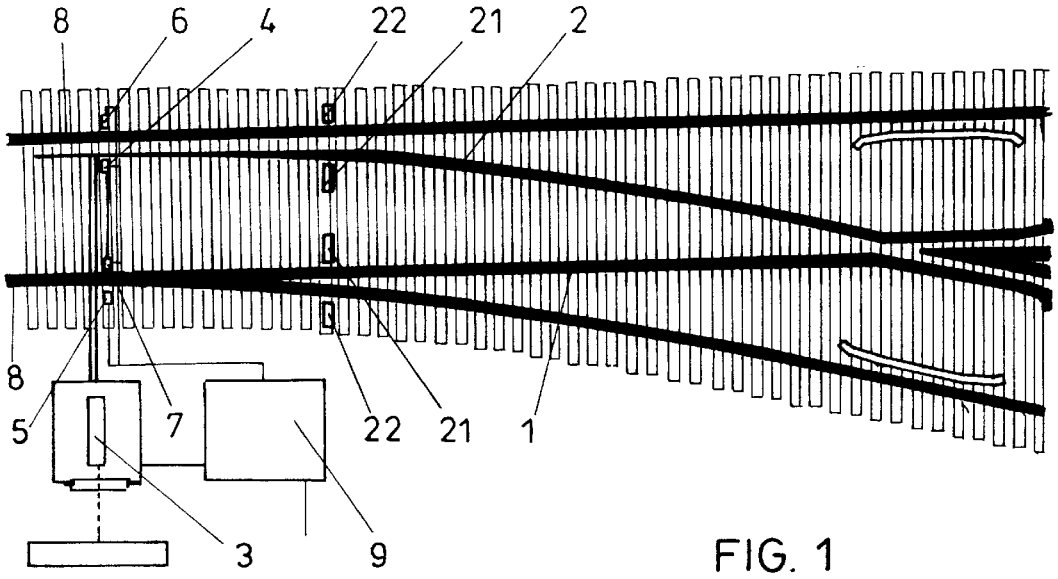
FIG. 1 illustrates the arrangement of the device according to the invention at a rail switch.

FIG. 1 shows two tongue rails 1 and 2 of a rail switch. By 3 a switching actuator is denoted, which places the tongues 1 and 2 in their respective positions. The continuous distance sensors of a measuring plane, that are required for detecting the positions of the tongue rails are denoted by 4, 5, 6 and 7. According to the schematic illustration, one sensor 5 at the tongue 1 in closed relationship to the stock rail 8, and one sensor 4 in the region of the tongue 2 in open relationship to the stock rail 8, are each damped in each of the rail switch positions. Two further sensors 6 and 7 are undamped in that position of the rail switch. It may be provided to detect the position of the closed tongue by means of a sensor oriented towards the rail web and 1hat of the open tongue by means of a sensor oriented towards the rail foot. Since, according to experience, the open tongue has a markedly larger position tolerance as opposed to the closed tongue, a larger measuring range may be provided for measuring the position of the open tongue than with the closed tongue. The higher resolution of a sensor provided for the smaller measuring range of the closed tongue takes into account the higher measuring accuracy required in that case. In addition to position detection, the switching circuit carries out the operability check of the electromechanically or electrohydraulically operating rail switching actuators.

Figure 2:
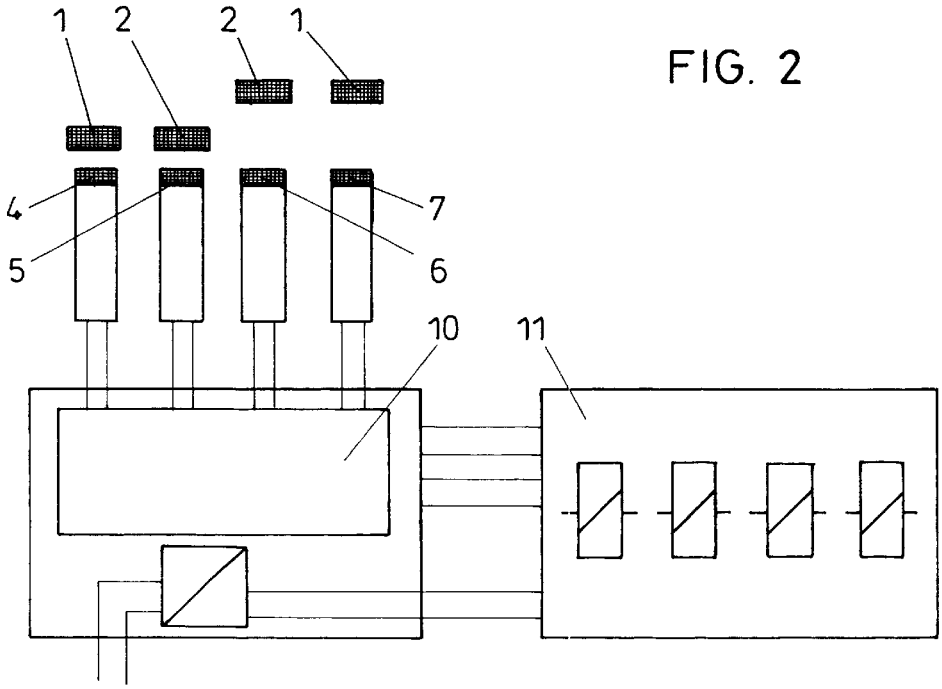
FIG. 2 depicts the principal circuit arrangement of the device for detecting the positions of pivotable parts of a railway switch, and FIG. 3 serves to describe in more detail the circuit arrangement by way of a detail of the circuit diagram of the electronics baseplate. From FIG. 4, the characteristic curves constituting the basis of characteristic curve interrogation are apparent.

FIG. 2 shows the tongue rails 1 and 2 in closed and respectively open relationship to the stock rail 8 and the continuous distance sensors 4, 5 and 6, 7 respectively damped and undamped according to the position of the tongue rails. As indicated schematically, the distance sensors are configured in the two-wire technique, the sensor signal being converted into a current proportional thereto and not falsified by resistivities. In a circuit and check logic 10, the signals of the sensors are further processed and the positions of the tongue rails are determined. Safety relays 11 are activated by the outputs 16 of the circuit and check logic 10.

FIG. 3 again depicts the continuously measuring distance sensors 4, 5, 6 and 7, whose signals are further processed on an electronics baseplate 12. On that electronics baseplate 12, the sensor signals are fed to two independently operating microcontrollers 15 and 16 with input protection lines 13 and frequency filters 14 being interposed. The two microcontrollers are interconnected for the purpose of mutual control and checking the functionability of the sensors. Via a circuit logic, which is not explained in detail herebelow, the outputs 16 of the baseplate control the safety relays 11. The microcontrollers perform the data-technological processing proper, of the sensor signals. The characteristic diagram computers determining the distances of the tongue rails by means of the characteristic curves stored are also integrated in the same, which is not illustrated in detail.

FIG. 4 illustrates the dependence of the tongue rail position on the sensor signal present in the form of a current. The function illustrated is based on a principle of action, which in turn is based on a static current. Static current means that the highest current absorption takes place without damping, this corresponding to the highest coordinate value of the characteristic curves shown in FIG. 4. Characteristic curve 1 shows the dependence of the path on the current of an initial curve of a sensor. By contrast, characteristic curve 2 represents a function resulting upon ageing of the sensor and expressed by a shift in the sense of arrow 18. By taking appropriate steps in terms of measuring technique, e.g., by comparison with the independently measured static current of the sensor, the characteristic curves may be adaptively adjusted in the sense of arrow 18 as a function of the changes caused by the ageing process. Due to the fact that, in addition to the function check by detecting the static current of the sensor in the undamped state, two tolerance ranges are defined within the characteristic curve diagram for the regions about the end positions in the closed state 19 and in the open state 20, the functionabilities of the sensors may be constantly monitored both in the damped and in the undamped states. The current signals adjusting upon resetting of a rail switch for error-free operation must be within the current range. If a signal does not come to lie within these tolerance ranges, the error either is to be attributed to an inadmissible position of the switch tongue or the sensor is defective. The occurrence of both of said failures simultaneously may be excluded in the light of the safety guidelines provided by the railway law.

Additional sensors 21 and 22 arranged in a further measuring plane are apparent from FIG. 1.

What is claimed is:

1. A device for detecting positions of parts of a rail switch, comprising at least one continuous distance sensor for producing an output representative of measured distance between a pivotable part and a fixed part of said switch, said output being connected to a circuit having stored therein characteristic curve data representative of said switch operating between open and closed positions, said circuit being configured to connect with the sensor output and the characteristic curve data to perform two separate evaluations, the first evaluation being a distance evaluation and the second evaluation being an evaluation as to whether the sensor is functioning properly.

2. A device according to claim 1, wherein an output of at least one further sensor measuring a static signal is connected with the circuit for use in the second evaluation.

3. A device according to claim 1, wherein at least two distance sensors are arranged at open and closed positions of pivotable parts of the rail switch in a common measuring plane on a track.

4. A device according to claim 3, wherein the characteristic curve data has tolerances of admissible functional ranges for open and closed positions of the pivotable parts and wherein a function control is effected for the open and closed positions.

5. A device according to claim 2, wherein the static signal. is connected to the circuit to calibrate the characteristic curve data.

6. A device according to claim 1, wherein the sensor output is a power output.

7. A device according to claim 1, wherein the circuit is connected with a memory.

8. A device according to claim 1, wherein a plurality of distance sensors are arranged in multiple measuring planes.

* * * * *